US005349146A

United States Patent [19]

Radabaugh

[11] Patent Number: 5,349,146

[45] Date of Patent: Sep. 20, 1994

[54] COMBINATION ELECTRICAL AND SUCTION HOSE WALL OUTLET

[75] Inventor: Kurtis R. Radabaugh, Ponca City, Okla.

[73] Assignee: Lindsay Manufacturing, Inc., Ponca City, Okla.

[21] Appl. No.: 833,979

[22] Filed: Feb. 11, 1992

[51] Int. Cl.[5] ..... H01H 3/20; A47L 5/38; H01R 4/60

[52] U.S. Cl. ..... 200/61.6; 15/314; 439/191

[58] Field of Search ..... 200/61.6; 439/190–195; 15/314

[56] References Cited

U.S. PATENT DOCUMENTS

| | | | |
|---|---|---|---|
| 3,076,068 | 1/1963 | Racklyeft | 200/61.6 |
| 3,655,927 | 4/1972 | Samuelson et al. | 200/61.6 |
| 4,194,230 | 3/1980 | Danford | 361/1 |
| 4,336,427 | 6/1982 | Lindsay | 200/61.6 |
| 4,664,457 | 5/1987 | Suchy | 339/15 |
| 4,758,170 | 7/1988 | Hayden | 439/142 |

*Primary Examiner*—A. D. Pellinen

*Assistant Examiner*—Michael A. Friedhofer

*Attorney, Agent, or Firm*—Stinson, Mag & Fizzell

[57] ABSTRACT

A combination electrical and suction hose outlet to be mounted to a building wall as part of a central vacuum cleaning system. In such a system, a remote vacuum cleaner suction hose is plugged into the wall outlet and has a power driven brush carpet sweeper end tool. A 110 volt AC line is formed into the hose and extends from the end tool to an electrical receptacle plug in the outlet. To provide a start signal to a central vacuum system motor, 24 volt DC wiring extends from the wall outlet to a motor controller. The high voltage and the low voltage power lines are maintained in electrical isolation by a circuit located at or near the wall outlet and including an optical coupler. When the end tool is turned on, AC flow is sensed by an associated circuit and the optical coupler is activated, causing a short in the DC power line to provide a start signal to the vacuum motor controller. With this system, the vacuum motor is started automatically when the power driven end tool is turned on. The system alleviates a need for both high power and low power switches at the hose handler or a low power switch in the wall outlet.

21 Claims, 4 Drawing Sheets

COMBINATION ELECTRICAL AND SUCTION HOSE WALL OUTLET

FIELD OF THE INVENTION

This invention relates to central vacuum cleaning system wall outlets and particularly to wall outlets which have an associated electrical connection.

BACKGROUND OF THE INVENTION

Central vacuum systems for homes and commercial buildings have been provided for many years and generally include a central vacuum power unit and dust receiving chamber located in a basement or closet of the building with vacuum conduits routed throughout the building from the central vacuum power unit to outlets conveniently located throughout the building. An operator merely carries a hose with him or her, moving from outlet to outlet while cleaning. The central vacuum cleaning power unit requires high voltage to efficiently power the suction motor which in the United States this is a 110/115 volt AC standard. The central vacuum motor can be turned on either at the unit or more conveniently, at wall switches at various locations in the building to which 110/115 volt AC power is routed to complete a circuit to the vacuum motor.

Alternatively, systems have been devised to send a start signal to the vacuum cleaning motor when an end of the portable cleaner hose is inserted in a wall outlet. Examples of such systems are shown in our earlier patents, U.S. Pat. Nos. 3,076,068 and 4,336,427. As disclosed therein, a low voltage wiring, such as 24 volt DC power, is routed to the wall outlet and either a switch is activated when the hose is plugged into the outlet, or spaced pins are provided which complete a circuit when a metal hose end coupling of a portable vacuum hose is inserted into the wall outlet. In these systems, a start signal is sent through the low voltage wiring to a motor controller associated with the central vacuum cleaning power, unit to start the main vacuum motor. Low voltage power, such as 24 volt DC power, has become the standard in the industry for such outlet switches because of safety factors and to avoid the risk of electrocution. Cleaning tool attachments may be connected to the ends of the vacuum hose such as a carpet cleaning brush. These carpet brushes are a combination wide vacuum nozzle with a rotating brush powered by an electric motor located at the hose end and a sealed unit. These carpet brushes also utilize high voltage electrical power, such as 110/115 volt AC.

To provide 110/115 volt AC power at the hose end, a separate electrical cord extends from the hose end to a building power electrical wall outlet which is preferably co-located with the vacuum outlet and which is installed in new construction buildings at the same time as installation of the vacuum hose outlet. Hose component manufacturers have provided vacuum hoses with two wire electrical lines for several years to avoid the obvious inconvenience of having completely separate electrical lines and vacuum hoses. With the development of unitary vacuum hoses and electrical lines, combination electrical outlet and vacuum outlet receptacles have been developed, such as shown in U.S. Pat. No. 4,664,475. These systems employ both the automatic turn-on and turn-off function of the wall outlet with the low voltage power control line and the carpet sweeper brush functions provided by the high voltage power line. When the vacuum hose is inserted into the wall outlet, the vacuum motor at the central vacuum power unit is operating. To stop the operation of the central vacuum system motor, the hose end must be pulled from the wall outlet. This can become an unwieldy chore for the operator, as the hose lengths are often quite long.

OBJECTS OF THE INVENTION

The objects of the present invention are: to provide a central vacuum cleaning system combination electrical and vacuum wall outlet which utilizes low voltage power to provide a start signal to a central vacuum cleaning system motor; to provide high voltage power to run vacuum hose end attachments; and to provide a start or stop signal through the low voltage wiring to the central vacuum system motor whenever a handle switch on the vacuum hose is turned on.

Another object of the present invention is to provide such a system which alleviates prior unhandy methods of operation which require disconnecting the hose end from a wall outlet each time the system is to be turned off.

Another object of the present invention is to provide such a vacuum cleaning system with electrical isolation between high voltage and low voltage power lines to insure safety of operation.

Yet another object of the present invention is to provide a combination electrical and suction hose outlet assembly which is economical to manufacture, sturdy and efficient in use, and well designed for the intended purpose.

SUMMARY OF THE INVENTION

The present invention is directed to a combination electrical and suction hose outlet assembly for a central vacuum cleaner system which has a wall valve assembly for connecting a remote vacuum cleaner suction hose to a central vacuum system, fixed suction hose conduit and which has an open ended outlet tube. A high voltage outlet plug receptacle is connected to a high voltage building power supply line and for connection to a remote vacuum cleaner suction hose power supply line. Circuit means in or associated with the assembly connect to the high voltage building power supply line and to low voltage power supply lines extending to a central vacuum system motor controller. The circuit means sense an initiation of current flow through a high voltage building power supply line and provide a start signal to the low voltage power control lines for start of the motor controller.

DESCRIPTION OF THE PREFERRED EMBODIMENT

Figure 1:
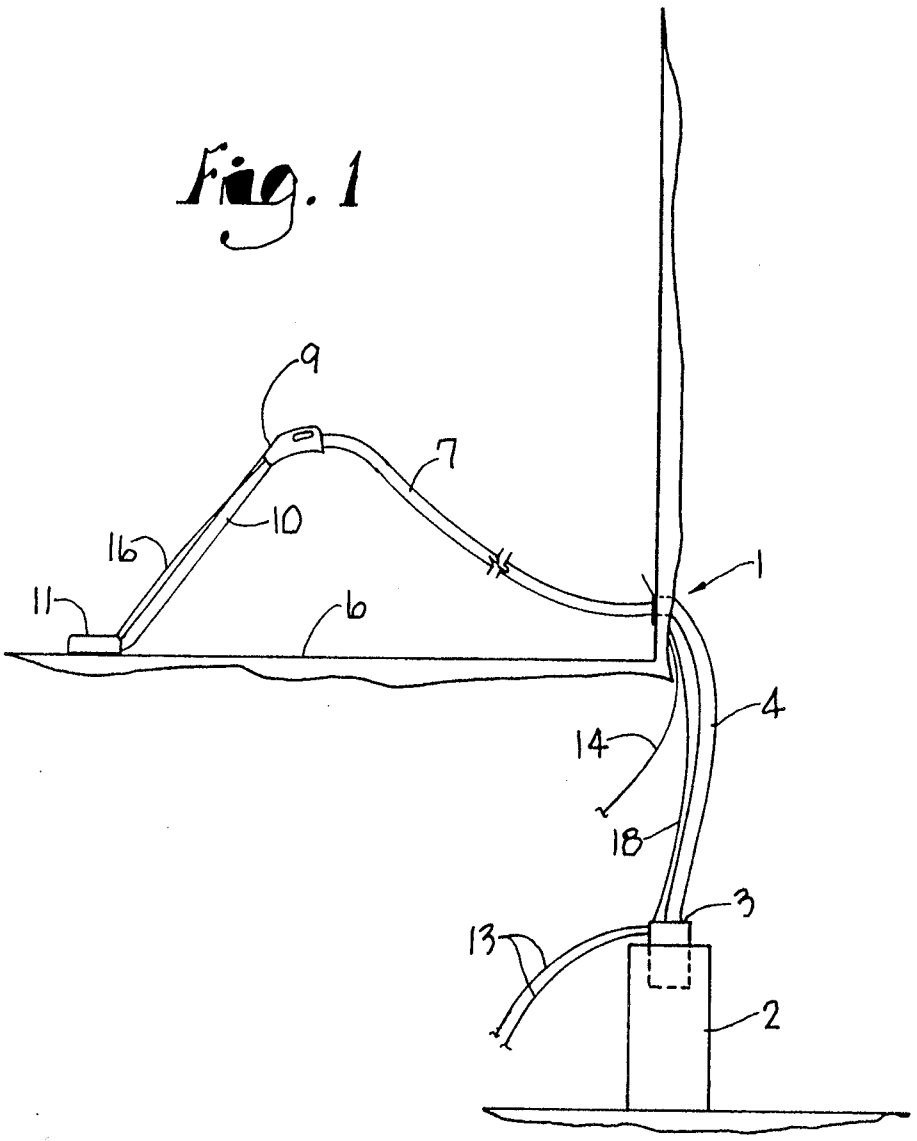
FIG. 1 is an elevational view depicting the major elements of a central vacuum cleaning system and showing a combination electrical and suction hose outlet assembly embodying the present invention.

As required, a detailed embodiment of the present invention is disclosed herein. It is, however, to be understood that the disclosed embodiment is merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1, FIG. 1, generally indicates a combination electrical and suction hose outlet assembly embodying the present invention. As shown in FIG. 1, the assembly 1 is used in conjunction with a central vacuum cleaning system which has a central vacuum cleaning system motor and dust receptacle assembly 2 operated through a motor controller 3. A central vacuum system fixed suction hose conduit 4 extends from the motor and dust receptacle assembly 2 to the electrical and suction hose outlet assembly 1, normally remotely located from the assembly 2 and positioned adjacent an area to be cleaned, such as a room or hallway 6. A length of portable vacuum cleaning hose 7 is removably plugged into the assembly 1 and can be taken from room to room by the cleaning person. The hose 7, in the illustrated example, leads to a handle assembly 9 which in turn is connected to a ridged wand 10, which has at its working end, an end attachment cleaning tool 11 which may, in the illustrated example, be a carpet sweeper type of attachment. The carpet sweeper tool 11 typically has a rotating brush together with a wide nozzle assembly with the rotating brush powered by an electric motor located in the tool 11. The electrical motor in the tool 11 may be turned on or off by a switch, located generally either at the tool 11 or in the handle assembly 9.

To provide electrical power to these various components, the motor and dust receptacle assembly 2 is generally powered by a high voltage electrical current which, in the United States, is a 110/115 volt AC power normally provided as building service. The electrical motor in the end tool 11 is also powered by a high voltage electrical system, normally the 110/115 volt AC building power supply system. These electrical lines are shown generally in FIG. 1 wherein the reference numeral 13 shows a high power line routed to the motor and dust receptacle assembly 2 through the motor controller 3 and the reference numeral 14 shows a building high power line routed to the assembly 1, connected therefrom to a high power line 16, attached to the hose 7, travelling through the handle assembly 9, down the wand 10 and into the tool 11. To control the vacuum motor assembly 2, a low voltage power line 18 extends from the assembly 1 to the motor controller 3. The motor and dust receptacle assembly 2 is operated by start and stop signals sent through the low power lines 18 from the hose outlet assembly 1 in response to current flow through the high power line 16. The high power lines 14 and 16 are maintained in electrical isolation from the low power line 18 at all times to insure safety of operation.

Figure 2:
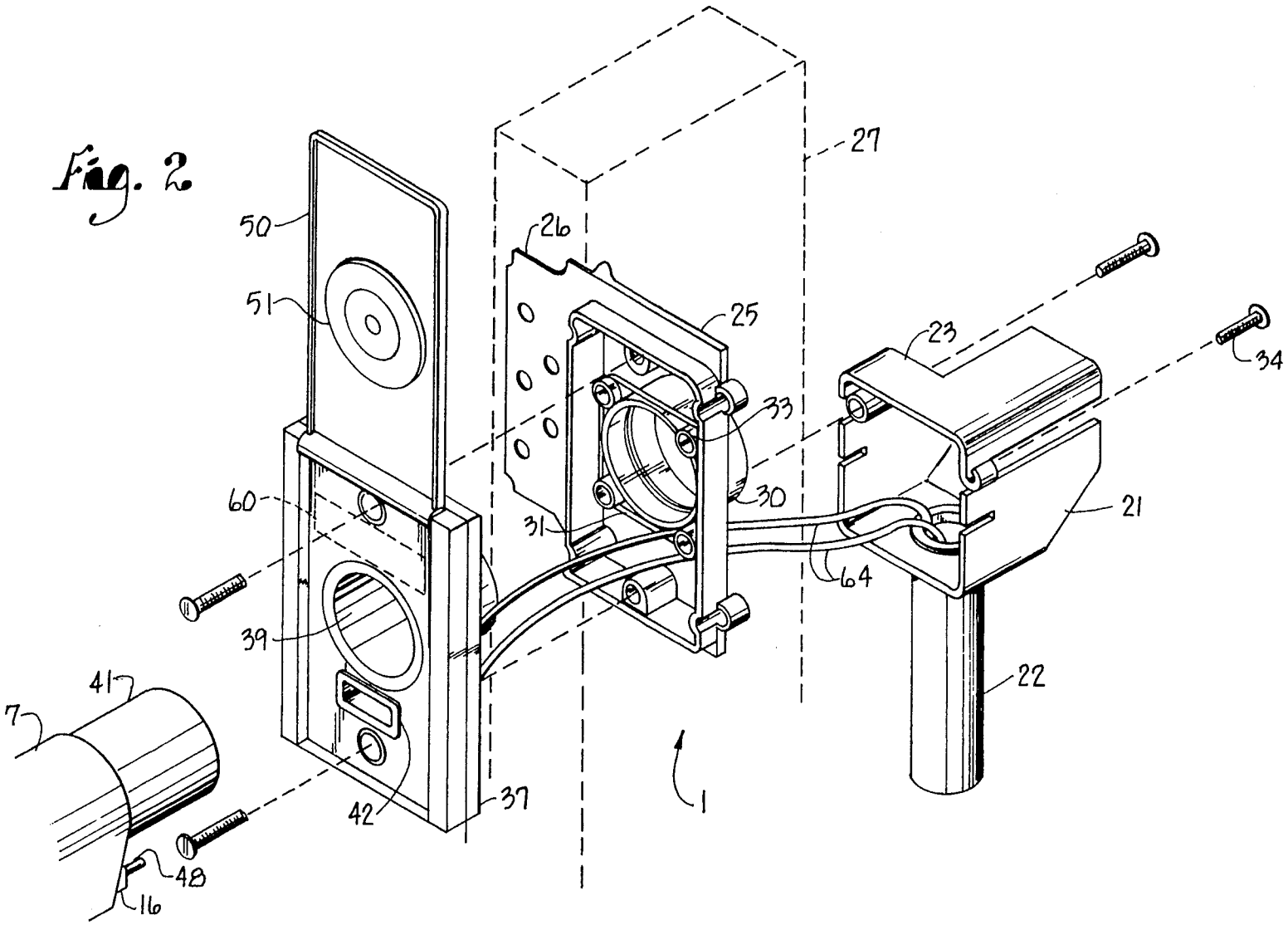
FIG. 2 is a disassembled view of a combination electrical and suction hose outlet assembly embodying the present invention.

Referring to FIG. 2, the combination electrical and suction hose outlet assembly 1 includes a junction box 21 to which an electrical conduit 22 is attached. The junction box 21 has an open rear end 23 so that the vacuum conduit 4 may be extended therethrough. The junction box 21 is attached to a wall bracket 25 having a flange 26 for attachment to a building wall stud 27. The wall bracket 25 includes a first collar 30 and a plurality of openings at 31 for passage of electrical wiring. Screw holes 33 permit connection of the various parts of the assembly 1 with the wall bracket 25 connected to the junction box 21 by screws 34 extending into selected screw holes 33. In the assembly the vacuum hose conduit 4 would extend into the junction box 21 through the rear end 23 and be connected to hose couplings as hereinafter described.

Figure 5:
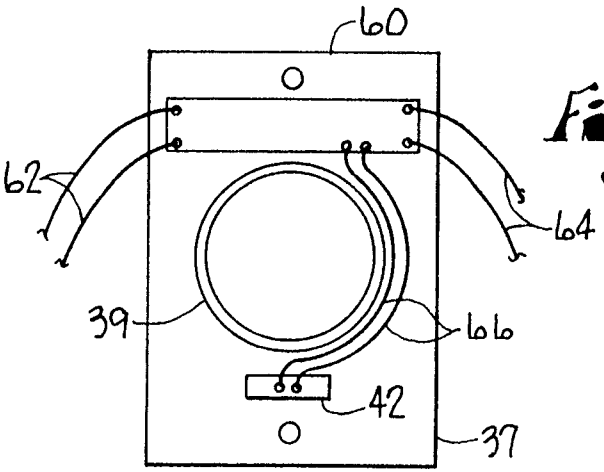
FIG. 5 is a rear elevational view of a portion of the combination electrical and suction hose outlet assembly.
Figure 3:
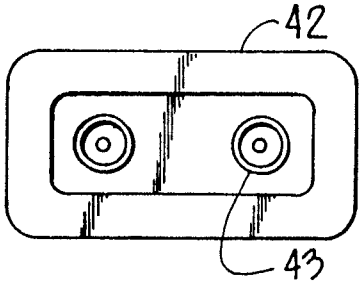
FIG. 3 is an end view showing an electrical receptacle in the electrical and suction hose outlet assembly.
Figure 4:
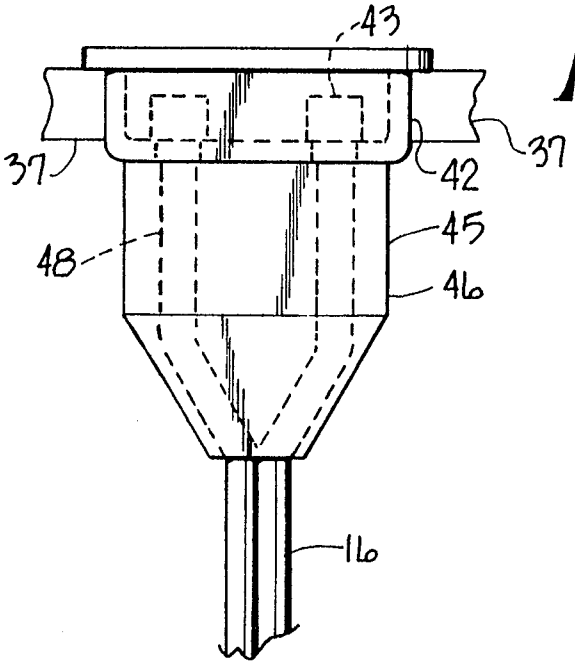
FIG. 4 is a plan view of the electrical receptacle.

An assembly face plate 37, FIG. 5, is designed to fit against the building wall with the wall bracket 25 extending through the wall surface, or sheet rock, from the rear side of the sheet rock with the face plate 37 attached to the wall bracket as by screws or other connecting fasteners. The face plate 37 includes a second collar 39, through which the assembly is inserted into the first collar 30 and which is sized to receive an end coupling 41 attached to the vacuum hose 7. The face plate 37 also includes an electrical outlet receptacle 42 which, as shown in FIG. 3, includes horizontally spaced circular contacts 43. The hose high power line 16 has an end electrical plug 45, FIG. 4, with a plug body 46 which fits into the receptacle 42 and has spaced circular prongs 48 which fit into the circular contacts 43.

To conceal the face plate 37, a hingedly mounted cover 50 is attached and is preferably spring biased to a downward position. The cover 50 has a disc 51 of resilient material attached to its inside surface and which is positioned so that as the cover 50 swings downwardly, the disc 51 covers and seals the second collar 39 in order to prevent loss of vacuum when the particular outlet assembly 1 is not being used.

Circuit means in the assembly 1 connected to the high voltage building power supply line 14 and 16 and to the low voltage power control lines 18 and sense an initiation of current flow through the high voltage power supply lines 14 and 16 to provide a start signal to the low voltage power control line 18 for start of the motor controller 3. In the illustrated example, the circuit means is located within a module 60, FIGS. 5 and 7, which has low voltage power control line leads 62 extending into one part of the module 60, high voltage building power supply line leads 64 connected to a second part of the module 60 and lines 66 extending from the module 60 to the high voltage power receptacle 42 for routing high voltage electrical power from the lines 14 to the building power supply line 16.

Figure 6:
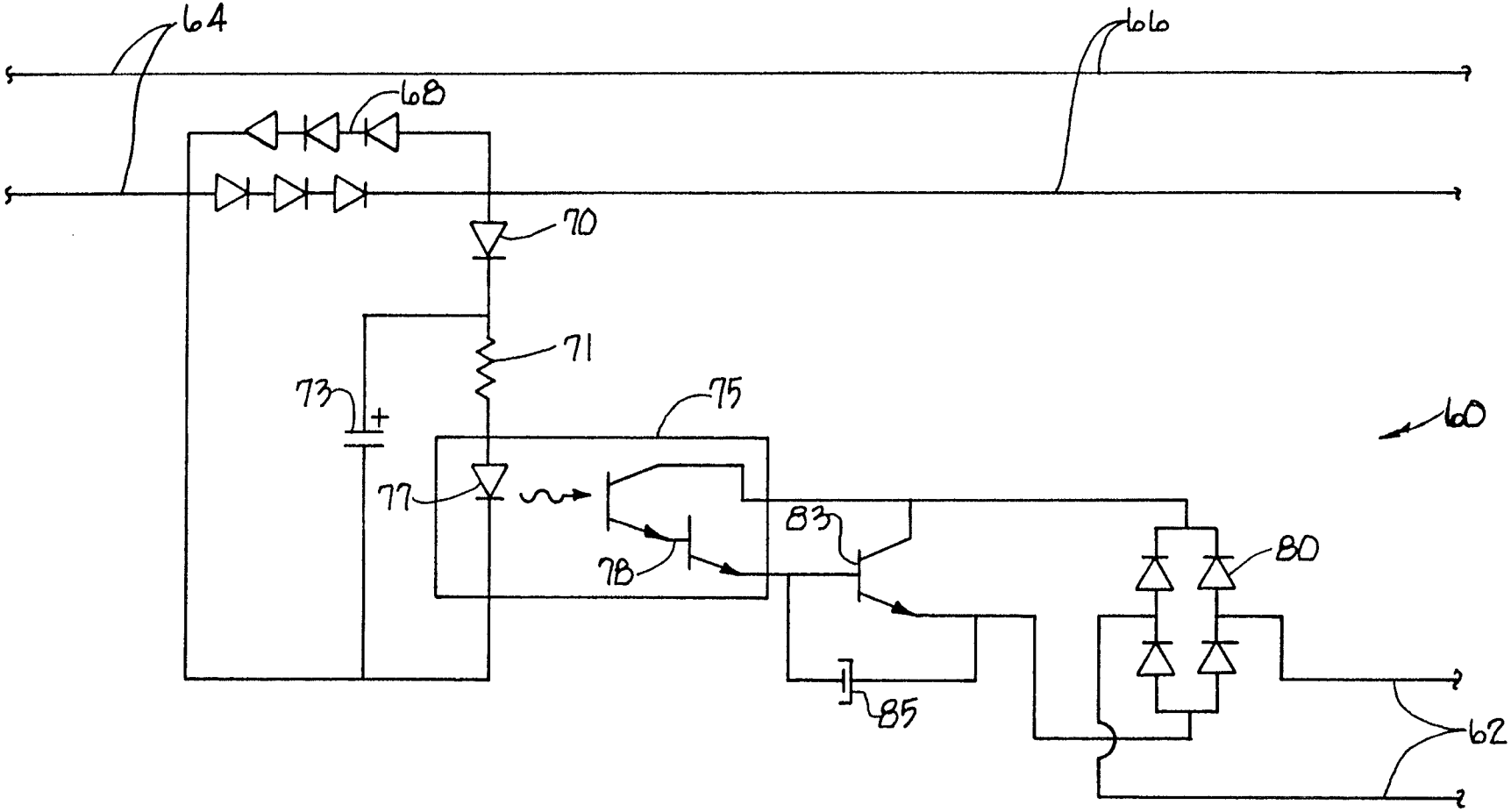
FIG. 6 is a diagrammetric view of the electrical circuit in the combination electrical and suction hose outlet assembly.

Referring to FIG. 6, the module 60 is shown diagrammetrically and with high voltage line 64 extending into the module and leading out of the module as high voltage leads 66. Either the leads 64 or 66, for operation of the circuit, can be 18 source or load and for illustrative purposes, leads 64 are considered the source lines. The module 60 provides an optical coupler which isolates high voltage power flow from the low voltage line leads 62 and causes an initiation or start signal to occur through the line leads 62 when current flow is sensed through the high voltage lines 64 and 66 such as inward current flow from the line leads 64.

The high voltage current first goes through a six diode package 68 consisting of three diodes arranged in one direction and a set of three diodes arranged in the opposite direction. During alternating current operation, the positive half of the alternating current wave goes through one set of diodes and then on the negative side of the alternating current sine wave, the current swings through to the other set of diodes to provide full plus and minus swing of AC voltage with a small amount of cross-over distortion. The diode package 68 produces a voltage drop of approximately 2.1 volts across them. Any ripple in the voltage is rectified by another diode 70 and from there the current flows into a 120 ohm half-watt resistor 71. Between the diode 70 and resistor 71 a lead goes to a 41 microfarad 25 volts capacitor 73. At this point, there is developed approximately 0.1 volts differential across an optical coupler unit 75 which in the illustrated example, is a sealed chip manufactured by Motorola, Number 4N32.

Within the optical coupler 75 an LED 77 emits light to a receiver 78 located on pins 4 and 5 of the optical coupler 75. Turning now to the low voltage input leads 62, there is a bridge rectifier diode package 80 consisting of four diodes. Either AC current or DC current is fed into the bridge rectifier package 80 which automatically selects polarity or converts the AC to DC. Current flows through the optical coupler 75 and out pin 4 into the base of a transistor 83. The transistor 83 is a B.D. 139 transistor and provides a large amount of current which then flows between the collector and the emitter of the transistor 83 to short out the output of the bridge rectifier 80. This effectively shorts out the low voltage remote control signal output with only approximately a 1.4 volt drop across the positive and negative wires. A 330 microfarad capacitor 85 in a line across the transistor 83 provides filtering which stores some charge during the slight off time in the optical coupler 75 and provides noise filtering. The transistor 83 provides a substantially zero ohm resistance path along the path indicated by the arrow. At that point the voltage that was developed across or the current that was developed from the diode bridge rectifier package 80 has effectively shorted out so the current flows through the low voltage contact and into the line leads 62. This effectively shorts the input to the bridge rectifier diode package 80. At that point the low voltage leads 62 are effectively shorted to turn on the low voltage control to the motor controller 3 of the central vacuum assembly 2.

The effect of this system is that it controls the low voltage initiated motor controller 3 with a high voltage source. Accordingly, turning on the electric motor in the end tool 11 initiates a start signal through the module 60 through the low voltage power control leads 62 and through the low voltage power line 18 to the motor controller 3 to turn on the vacuum cleaning system. The load from the electrical motor in the end tool 11 provides a current draw in the high voltage lines which will initiate the optical coupler 75. Alternatively, a simple load resistor or the like could be placed within a switch in the handle assembly 9 sufficient to cause a current flow to initiate the optical coupler 75. In the later situation, an end tool with an electric motor would not be required.

In summary, the combination electrical and suction hose outlet assembly includes wall valve for connecting a remote vacuum cleaner suction hose to a central vacuum system fixed suction hose conduit. A high voltage outlet plug receptacle is connected to a high voltage building power supply line and for connection to a high voltage electrical line extending along the length of the hose. A circuit means in the assembly 1 connects to the high voltage building power supply line and to the low voltage power control lines extending to the motor controller 3 and upon sensing an initiation of current flow through the high voltage power supply lines provides start or stop signals to the low voltage power control lines for control of the motor controller 3.

Figure 7:
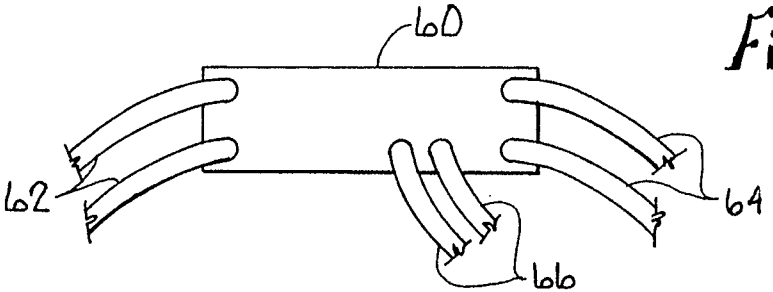
FIG. 7 is a plan view of an electrical circuit device which may be either mounted on the outlet assembly or be separate.

Note that in FIGS. 1 through 6, the module 60 is attached to a part of the wall valve. However, the module 60 may be separate from the assembly and merely in the electrical lines 64 and 66 so that it is associated with the assembly 1. Such a configuration is shown in FIG. 7.

It is to be understood that while one form of this invention has been illustrated and described, it is not to be limited to the specific form or arrangement of parts herein described and shown, except insofar as such limitations are included in the following claims.

What is claimed and desired to be secured by Letters Patent is as follows:

1. A combination electrical and suction hose outlet assembly for a central vacuum cleaning system comprising:

a) wall valve means for connecting a remote vacuum cleaner suction hose to a central vacuum system fixed suction hose conduit and having an open ended outlet tube;

b) a high voltage outlet plug receptacle connected to high voltage building power supply line leads and for connection to a remote vacuum cleaner suction hose power supply line; and c) circuit means in said assembly for connection to said high voltage building power supply line leads and to low voltage power control lines extending to a central vacuum system motor controller, said circuit means sensing an initiation of current flow through a high voltage hose power supply line and having a rectifier means for providing a start signal to said low voltage power control lines for start of said motor controller.

2. The assembly set forth in claim 1 wherein said circuit means includes an optical coupler activated by current flow through said high voltage power supply line and has a switch which shorts out said low voltage power control lines to said rectifier means for providing said start signal.

3. A combination electrical and suction hose outlet assembly for a central vacuum cleaning system comprising:

a) wall valve means for connecting a remote vacuum cleaner suction hose to a central vacuum system fixed suction hose conduit and having an open ended outlet tube;

b) means for connecting a high voltage building power supply line to said assembly and having an outlet plug receptacle in said assembly for connection with a remote vacuum cleaner suction hose power supply line;

c) means for connecting a low voltage power control line to said assembly whereby said low voltage power control line extends to a central vacuum system motor controller;

d) circuit means in said assembly interposed between said means for connecting a high voltage building power supply line and said means for connecting a low voltage power control line, said circuit means sensing current flow through said remote vacuum cleaner suction hose power supply line and having a rectifier means for providing a motor start signal through said low voltage power control line to said central vacuum system motor controller.

4. A combination electrical and section hose outlet assembly for a central vacuum cleaning system comprising:

a) wall valve means for connecting a remote vacuum cleaner suction hose to a central vacuum system fixed suction hose conduit and having an open ended outlet tube connected to said suction hose conduit;

b) a high voltage building power supply line extended to said assembly and having an outlet plug receptacle in said assembly for connection with a remote vacuum cleaner suction hose power supply line;

c) a low voltage power control line extended between said assembly and a central vacuum system motor controller; and d) circuit means in said assembly connected to said high voltage building power supply line and to said low power control line and having means for sensing current flow through said remote vacuum cleaner suction hose power supply line and having a rectifier means for providing a motor start signal through said low voltage power control line to said central vacuum system motor controller.

5. A combination electrical and suction hose outlet assembly for a central vacuum cleaning system comprising:

a) wall valve means for connecting a remote vacuum cleaner suction hose to a central vacuum system fixed suction hose conduit and having an open ended outlet tube connected to said suction hose conduit;

b) a 110 volt AC building power supply line extended to said assembly and having an outlet plug receptacle in said assembly for connection with a remote vacuum cleaner suction hose power supply line;

c) a 24 volt DC power control line extended between said assembly and a central vacuum system motor controller; and d) circuit means in said assembly connected to said 110 volt AC building power supply line and to said 24 volt DC power control line and having means for sensing current flow through said remote vacuum cleaner suction hose power supply line and having a rectifier means for providing a motor start signal through said 24 volt power control line to said central vacuum system motor controller.

6. The assembly set forth in claim 5 wherein said circuit means includes an optical coupler activated by current flow through said remote vacuum cleaner suction hose power supply line and which shorts said 24 volt power control line and has a rectifier means after to provide said start signal to said central vacuum system motor controller.

7. The assembly set forth in claim 5 wherein said circuit means includes a switch means electrically isolating said 110 volt building power supply line from said 24 volt power control line.

8. The assembly set forth in claim 7 wherein said switch means is an optical coupler.

9. A combination electrical and suction hose outlet assembly for a central vacuum cleaning system comprising:

a) wall valve means for connecting a remote vacuum cleaner suction hose to a central vacuum system fixed suction hose conduit and having an open ended outlet tube;

b) a high voltage outlet plug receptacle connected to high voltage building power supply line leads and for connection to a remote vacuum cleaner suction hose power supply line; and c) circuit means associated with said assembly for connection to said high voltage building power supply line leads and to low voltage power control lines extending to a central vacuum system motor controller, said circuit means sensing an initiation of current flow through said remote vacuum cleaner suction hose power supply line and having a rectifier means for providing a start signal to said low voltage power control lines for start of said motor controller.

10. A combination electrical and suction hose outlet for a central vacuum cleaning system comprising:

a) a wall bracket, a face plate, and an electrical module, said face plate and said electrical module for fitting into a junction box;

b) said junction box for inserting into to said wall bracket and having a vacuum conduit extended through said junction box, said vacuum conduit being connected with a central vacuum cleaning system suction means;

c) said wall bracket for connecting to a building wall and having a first collar being connected with said vacuum conduit;

d) said face plate attachable to said wall bracket and including a second collar and an electrical outlet receptacle, said second collar being received by said first collar and for connection means to a central vacuum cleaning hose having a high voltage power supply line attached thereto, said outlet receptacle having leads for connection to a high voltage building power supply line, said face plate having a cover for said second collar when said combination electrical and suction hose outlet is not being used; and e) said module being mounted onto said face plate and having a control circuit having an optical coupler, a switch and a rectifier means, said control circuit for connection to said high voltage building power supply line leads, to low voltage power control lines extending to a central vacuum system motor controller and to said switch which is connected to said rectifier means for sending low voltage control power to activate said central vacuum motor controller, said coupler sensing current flow through said high voltage hose power supply line and sending said current flow to said switch for shorting out said low voltage control power lines and causing said rectifier means to send a smart signal to activate said central vacuum motor controller.

11. A combination electrical and suction hose outlet for a central vacuum cleaning system comprising:

a) a wall bracket, a face plate and an electrical module, said face plate and said module for fitting into a junction box;

b) said junction box for inserting into said wall bracket and having a vacuum conduit extended through said junction box, said vacuum conduit for connection to a central vacuum cleaning system suction means;

c) said wall bracket for connection to a building wall and having a first collar for connection to said vacuum conduit;

d) said face plate attachable to said wall bracket and including a second collar and an electrical outlet receptacle, said second collar being received by said first collar and for connection to a central vacuum cleaning hose having a 110 volt AC power supply line attached thereto, said outlet receptacle for connection to 110 volt AC building power supply line leads, said face plate having a cover for said second collar when said combination electrical and suction hose outlet is not being used;

e) said module for connection to a 24 volt DC power control line and to said outlet receptacle, said 24 volt DC power control line extending to a central vacuum system motor controller; and f) said module being mounted onto said face plate and having a control circuit having an optical coupler, a switch and a rectifier means, said coupler being connected to said switch which is connected to said rectifier means, said coupler sensing current flow through said 110 volt AC hose power supply line and sending said current flow to said switch for shorting out said 24 volt DC power control line causing said rectifier means to send a start signal to activate said central vacuum motor controller.

12. A combination electrical and suction hose outlet for a central vacuum cleaning system comprising:

a) a wall bracket, a face plate and an electrical module, said face plate and said electrical module for fitting into a junction box;

b) said junction box for inserting into said wall bracket and having a vacuum conduit extended through said junction box, said vacuum conduit for connection to a central vacuum cleaning system suction means;

c) said wall bracket for connection to a building wall and having a first collar for connection to said vacuum conduit;

d) said face plate attachable to said wall bracket and including a second collar and an electrical outlet receptacle, said second collar being received by said first collar and for connection to a central vacuum cleaning hose having a 110 volt AC power supply line attached thereto, said outlet receptacle for connection to 110 volt AC building power supply line leads and having connection means to said 110 volt AC voltage hose power supply line, said face plate having a cover for said second collar when said combination electrical and suction hose outlet is not being used;

e) said module mounted onto said face plate and being connectable to a 24 volt DC power control line and to said outlet receptacle, said 24 volt DC power control line extending to a central vacuum system motor controller; and f) said module having a control circuit for sensing current flow through said 110 volt AC hose power supply line and a rectifier means for sending a start signal through said 24 volt DC power control lines to activate said central vacuum motor controller.

13. The combination electrical and suction hose outlet set forth in claim 12 wherein said control circuit includes an optical coupler and a switch, said coupler being connected with said switch which is connected to said rectifier means, said coupler sensing said current flow through said 110 volt AC hose power supply line and sending said current flow to said switch for shorting out said 24 volt DC power control line causing said rectifier means to send said start signal to activate said central vacuum motor controller.

14. The combination electrical and suction hose outlet set forth in claim 12 wherein said control circuit includes a switch means, said switch means electrically isolating said 110 volt AC building power supply line from said 24 volt DC power control line, sensing said current flow through said 110 volt AC hose power supply line and shorting out said 24 volt DC power control line causing said rectifier means to send said start signal to activate said central vacuum motor controller.

15. The combination electrical and suction hose outlet set forth in claim 14 wherein said switch means includes an optical coupler.

16. A combination electrical and suction hose outlet assembly for a central vacuum cleaning system comprising:

a) an outlet and an electrical module, said outlet having a wall bracket and a face plate for fitting into a junction box;

b) said junction box for inserting into a building wall and having a vacuum conduit extended through said junction box, said vacuum conduit being connected with a central vacuum cleaning system suction means;

c) said wall bracket for connecting to said building wall and having a first collar being connected with said vacuum conduit;

d) said face plate attachable to said wall bracket and including a second collar and an electrical outlet receptacle, said second collar being received by said first collar and for connection to a central vacuum cleaning hose having a high voltage power supply line attached thereto, said outlet receptacle having leads for connection to a high voltage building power supply line, said face plate having a cover for said second collar when said assembly is not being used; and e) said module being mountable adjacent to said face plate and having a control circuit having an optical coupler, a switch and a rectifier means, said control circuit for connection to said high voltage building power supply line leads, to low voltage power control lines extending to a central vacuum system motor controller and to said switch which is connected to said rectifier for sending low voltage control power to activate said central vacuum motor controller, said coupler sensing current flow through said high voltage hose power supply line and sending said current flow to said switch for shorting out said low voltage control power line and causing said rectifier to send a motor start signal to activate said central vacuum motor controller.

17. A combination electrical and suction hose outlet assembly for a central vacuum cleaning system comprising:

a) an outlet and an electrical module, said outlet having a wall bracket and a face plate for fitting into a junction box;

b) said junction box for inserting into a building wall and having a vacuum conduit extending through said junction box, said vacuum conduit for connection to a central vacuum cleaning system suction means;

c) said wall bracket for connection to said building wall and having a first collar for connection to said vacuum conduit;

d) said face plate attachable to said wall bracket and including a second collar and an electrical outlet receptacle, said second collar being received by said first collar for connection to a central vacuum cleaning hose having a 110 volt AC power supply line attached thereto, said outlet receptacle having leads connected to a 110 volt AC building power supply line, said face plate having a cover for said second collar when said assembly is not being used;

e) said module being mountable adjacent to said face plate and being connectable to 24 volt DC power control line and said outlet receptacle, said 24 volt DC power control line extending to a central vacuum system motor controller; and f) said module having a control circuit having an optical coupler, a switch and rectifier means, said coupler being connected to said switch which is connected to said rectifier means, said coupler sensing current flow through said 110 volt AC hose power supply line and sending said current flow to said switch for shorting out said 24 volt DC power control line causing said rectifier means to send a start signal to activate said central vacuum motor controller.

18. A combination electrical and suction hose outlet assembly for a central vacuum cleaning system comprising:

a) an outlet and an electrical module, said outlet having a wall bracket and a face plate for fitting into a junction box;

b) said junction box for inserting into a building wall and having a vacuum conduit extended through said junction box, said vacuum conduit for connection to a central vacuum cleaning system suction means;

c) said wall bracket for connection to said building wall and having a first collar for connection to said vacuum conduit;

d) said face plate attachable to said wall bracket and including a second collar and an electrical outlet receptacle, said second collar being received by said first collar and for connection to a central vacuum cleaning hose having a 110 volt AC power supply line attached thereto, said outlet receptacle for connection to 110 volt AC building power supply line leads and having connection means to said 110 volt AC voltage hose power supply line, said face plate having a cover for said second collar when said combination electrical and suction hose outlet is not being used;

e) said module being mountable adjacent to said face plate and being connectable to a 24 volt DC power control line and said outlet receptacle, said 24 volt DC power control line extending to a central vacuum system motor controller; and f ) said module having a control circuit for sensing current flow through said 110 volt AC hose power supply line and a rectifier means for sending a start signal through said 24 volt DC power control line to activate said central vacuum motor controller.

19. The combination electrical and suction hose outlet set forth in claim 18 wherein said control circuit includes an optical coupler and a switch, said coupler being connected with said switch which is connected to said rectifier means, said coupler sensing said current flow through said 110 volt AC hose power supply line and sending said current flow to said switch which shorts said 24 volt DC power control line to provide said start signal to activate said central vacuum motor controller.

20. The combination electrical and suction hose outlet set forth in claim 18 wherein said control circuit includes a switch means and a rectifier means, said switch means electrically isolating said 110 volt AC building power supply line from said 24 volt DC power control line, sensing said current flow through said 110 volt AC hose power supply line and shorting said 24 volt DC power control line causing said rectifier means to provide a start signal to activate said central vacuum motor controller.

21. The combination electrical and suction hose outlet set forth in claim 20 wherein said switch means includes an optical coupler.

* * * * *